US005893009A

United States Patent [19]

Yamada

[11] Patent Number: 5,893,009

[45] Date of Patent: Apr. 6, 1999

[54] IMAGE FORMING APPARATUS AND IMAGE FORMING METHOD FOR CHANGING SHEET TRANSPORT SPACING ACCORDING TO ENVIRONMENTAL CONDITIONS

[75] Inventor: Takanobu Yamada, Toyokawa, Japan

[73] Assignee: Minolta Co., Ltd., Osaka, Japan

[21] Appl. No.: 79,142

[22] Filed: May 15, 1998

[30] Foreign Application Priority Data

May 16, 1997 [JP] Japan ..... 9-141135

[51] Int. Cl.[6] ..... G03G 15/00

[52] U.S. Cl. ..... 399/44; 399/45; 399/66

[58] Field of Search ..... 399/44, 45, 66, 399/299, 388; 347/115, 116, 117

[56] References Cited

U.S. PATENT DOCUMENTS 4,634,262 1/1987 Imaizumi et al. .

5,465,135 11/1995 Nakagama et al. ..... 399/44

5,552,862 9/1996 Masuda et al. ..... 399/44

5,652,943 7/1997 Matsuo ..... 399/45 X 5,717,980 2/1998 Oka et al. ..... 399/66

*Primary Examiner*—Arthur T. Grimley

*Assistant Examiner*—Sophia S. Chen

*Attorney, Agent, or Firm*—McDermott, Will & Emery

[57] ABSTRACT

An image forming apparatus and an image forming method capable of preventing image noise caused by separation discharge between a photosensitive member and a recording sheet while suppressing to a minimum limit the reduction in production efficiency, by detecting environmental conditions and changing the transport spacing of the recording sheet in accordance with the detected environmental conditions.

22 Claims, 5 Drawing Sheets

IMAGE FORMING APPARATUS AND IMAGE FORMING METHOD FOR CHANGING SHEET TRANSPORT SPACING ACCORDING TO ENVIRONMENTAL CONDITIONS

CROSS-REFERENCE TO RELATED APPLICATIONS

This application is based on Application No. HEI 9-141135 filed in Japan, the contents of which are hereby incorporated by reference.

BACKGROUND OF THE INVENTION

1. Field of the Invention

The present invention relates to an image forming apparatus such as electrophotographic copiers, printers or the like and image forming method, and more specifically relates to an image forming apparatus and image forming method for changing the recording sheet transport spacing according to environmental conditions.

2. Description of the Related Art

In image forming apparatuses of the electrophotographic type such as copiers, printers and the like, an electrostatic latent image of the image to be reproduced is formed on the surface of a photosensitive member, said latent image is developed as a toner image, and said toner image is transferred onto a recording sheet and subjected to a fixing process to form the finished image on said recording sheet.

In the aforesaid processing, for example, the surface of a photosensitive member is uniformly charged to a negative polarity by a charger beforehand, and the image to be reproduced is projected onto the charged surface of the photosensitive member so as to discharge the area in which the image is projected, and this image is developed by toner charged to a negative polarity such that said charged toner only adheres to the image area and forms a toner image. In order to transfer the toner image formed on the surface of the photosensitive member onto a recording sheet, a charge having an opposite polarity (positive) is applied to the recording sheet via a transfer charger disposed on the underside of said recording sheet so as to transfer said toner image to the recording sheet. At this time, the recording sheet is electrostatically adhered to the photosensitive member because the photosensitive member is charged with a negative polarity and the recording sheet is charged with a positive polarity. Therefore, in order to separate the recording sheet from the photosensitive member, the charge of the recording sheet is neutralized by a seperation charger in a process to separate the recording sheet from the photosensitive member.

When the recording sheet separates from the photosensitive member, the charge of the recording sheet is neutralized to a certain degree although not completely neutralized by the separation charger, such that a residual positive charge remains on the recording sheet and the photosensitive member is charged with a negative polarity. Therefore, when the trailing edge of the recording sheet separates from the photosensitive member, a discharge is generated between the sheet and the photosensitive member in a phenomenon called a separation discharge which causes the position corresponding to the trailing edge of the recording sheet on the surface of the photosensitive member to be charged with a positive polarity. In the present specifications, the trailing edge of the recording sheet is defined as the edge of the recording sheet on the downstream side relative to the recording sheet transport direction in the image forming apparatus.

After the toner image formed on the surface of the photosensitive member has been transferred to the recording sheet, the photosensitive member is subjected to an optical erasure process by passing below an eraser lamp to eliminate the remaining residual charge. In the part of the photosensitive member charged with a positive polarity by the aforesaid separation discharge, however, the residual charge cannot be eliminated by the optical erasure process and travels to the charger with the residual positive polarity charge intact. Although a charge of negative polarity is imparted to the photosensitive member by the charger, a potential difference cannot accumulate in aforesaid area of the residual charge of positive polarity such that a shift occurs in the surrounding charge to the positive polarity side at position corresponding to the trailing edge of the recording sheet on the surface of the photosensitive member, and toner adheres in this area by the developing process for a subsequent image so as to cause black lines (noise) in the developed image.

FIG. 5 illustrates the situation in which black lines (noise) appear in a subsequent image when the photosensitive member has a residual charge of positive polarity due to separation discharge. A toner image formed on the surface of photosensitive member "a" having a diameter D is transferred onto a first recording sheet P1', and when a separation discharge is generated at point S when the trailing edge of recording sheet P1' separates from photosensitive member "a", a residual positive charge is imparted at area S on the surface of photosensitive member "a". An image to be transferred to a second recording sheet P2' is subsequently formed on the surface of photosensitive member "a". At this time, a line-like toner image is formed in the area of residual positive charge when said image is developed by toner due to the positive charge remaining at area S on the surface of photosensitive member "a". When the transport spacing M between the first recording sheet P1' and second recording sheet P2' is shorter than the circumferential length L ($=\mu D$) of the photosensitive member "a" ($M<L$), the line-like toner image adhered by the residual charge imparted by the separation discharge is developed as line "t" on the image transferred to the second recording sheet P2'.

Particularly in systems which form color images, a plurality of image formations are repeated for the separate colors, and the transfer process of transferring the toner on the surface of photosensitive member is also repeated a plurality of times. Therefore, there is an increase in the residual charge on the recording sheet and separation discharge readily occurs.

In color image processing, unlike typical monochrome image processing, colored image is also formed in the area of the background of an image. Therefore, an image is frequently formed in the area of the trailing edge of the recording sheet and separation discharge readily occurs.

Heretofore two measures have been proposed as countermeasures to the previously described image noise induced by separation discharge. A first countermeasure is a method wherein a charge is imparted by a charger to the area of abnormal charge induced by separation discharge so as to return said area to its original potential. Specifically, a charger is disposed on the downstream side of the transfer charger and on the upstream side of a cleaner (i.e., a device which cleans the surface of the photosensitive member by removing residual toner remaining on said surface after a toner image formed on the photosensitive member has been transferred to recording sheet) relative to the direction of rotation of the photosensitive member, and this charger imparts a potential of opposite polarity to the area of the photosensitive member charged by separation discharge to return said area to its original potential, and thereafter said charge is erased by an optical erasure process.

This method, however, requires the provision of a charger to correct the potential of the photosensitive member in addition to the essential construction for a normal electrophotographic process, and is disadvantageous insofar as this method increases the number of components and cost. Notably, in tandem-type image forming apparatuses, the aforesaid method produces deeper disadvantages than increased number of components and cost due to the necessity of multiple preparations. Tandem-type image forming apparatuses include image forming apparatuses provided with a plurality (in this example, four) electrophotographic processing units of a plurality of colors corresponding to, e.g., yellow (Y), magenta (M), cyan (C), black (Bk), to form color images, wherein the toner image of each color formed on the surface of a photosensitive member provided with said electrophotographic units are consecutively transferred to and overlaid on a recording sheet to form a color image.

When the aforesaid charger is disposed downstream from the transfer charger and upstream from a cleaner relative to the direction of rotation of the photosensitive member, the spatial arrangement of the charger cannot be assured without enlarging the diameter of the photosensitive member. On the other hand, when the diameter of the photosensitive member increases, the size of the image forming apparatus also increases. Particularly in the case of tandem type image forming apparatuses, enlarging the diameter of the photosensitive member produces a markedly greater effect on size than in the case of typical image forming apparatuses (of the type which form images using a single processing unit) because each of the photosensitive members of a plurality of electrophotographic processing units must be enlarged. In tandem type image forming apparatuses provided with delay memory to adjust the shifting of image data processing timing among the various electrophotographic processing units, increasing the size of the photosensitive member results in increased distance between said electrophotographic processing units and necessitates a delay memory of greater capacity.

A second countermeasure is to increase the transport spacing between recording sheets. Specifically, if the transport spacing of the recording sheets is lengthened so as to be greater than the circumferential length of the photosensitive member, the abnormally charged area of the photosensitive member charged by separation discharge will not enter the region to which an image to be transferred to a subsequent recording sheet is formed, as can be clearly seen in FIG. 5. When the transport spacing of the recording sheets is increased in this way so as to be greater than the circumferential length of the photosensitive member, the photosensitive member must idle rotate (rotation without image formation) at least one rotation to pass under the charger before image formation to neutralize the abnormal charge. Accordingly, when the charger imparts a charge to the surface of the photosensitive member in the image formation stage, the influence of the separation discharge is eliminated and the surface of the photosensitive member can be uniformly charged.

The following disadvantages arise, however, when the transport spacing of the recording sheets is increased. A first disadvantage is a reduction in production efficiency caused by a reduction in the number of image formations that can be accomplished per unit time. A second disadvantage is the increased cost of a single image formation sheet caused by the reduced service life of the photosensitive members and developing devices due to the increased operating time of said photosensitive members and developing devices compared to the same number of image formations when the transport spacing between recording sheets is not increased.

For example, when the diameter of the photosensitive member is 60 mm and the processing speed is 120 mm/sec, the transport spacing of the recording sheets must be a minimum of 60 mm×3.14, or about 190 mm to avoid the effects of separation discharge. In typical image forming apparatuses, a transport spacing of about 60 mm is adequate even considering the scanner return time.

In image forming processes for A4 size portrait oriented (i.e., the lengthwise direction of the sheet is parallel to the transport direction) recording sheets, the typical image forming apparatus produces 120×60/(210+60)=27 sheets/min, whereas increasing the transport spacing of the recording sheets to avoid the effect of separation discharge produces 120×60/(210+190)=18 sheets/min. That is, even at identical processing speeds, the number of image formations that can be processed per unit time is reduced to about ⅔. Furthermore, the service life of consumable components is also reduced by this same ratio.

SUMMARY OF THE INVENTION

The generation of the abnormal charge area on the surface of the photosensitive member by the previously described separation discharge is not a normal occurrence, but readily occurs under environmental conditions of high humidity. Particularly when paper medium such as plain paper is used as the recording sheet, the moisture content of the recording sheet under high humidity conditions reduces the electrical resistance of the recording sheet. As a result, the charge imparted to the recording sheet by the transfer charger readily flows to the interior of the recording sheet, such that a charge accumulates in the trailing edge of the recording sheet and separation discharge readily occurs.

During periods of high humidity the amount of charge in the developer, e.g., toner, is also reduced. As a result, the image density is elevated. In order to correct the elevation of the image density, the image density is adjusted by reducing the developing bias voltage and the charging potential. In this instance, since the image is reproduced at a low contrast potential by reducing the developing bias voltage and charging potential, a slight image density difference is manifested as a change in image density. Therefore, even a slight charge produced by abnormal charging of the surface of the photosensitive member due to separation discharge is manifested as image noise.

An object of the present invention is to provide an improved image forming apparatus and image forming method which eliminate the previously described disadvantages.

Another object of the present invention is to provide an image forming method and image forming apparatus capable of preventing image noise caused by separation discharge between a photosensitive member and a recording sheet while suppressing to a minimum limit the reduction in production efficiency.

These objects are attained by providing an image forming apparatus and image forming method by determining environmental conditions under which separation discharge readily occurs, and forming images by increasing the recording sheet transport spacing so as to be longer than normal during periods of environmental conditions under which separation discharge readily occurs, and forming images using a normal recording sheet transport spacing at other times.

More specifically, the aforesaid objects are attained by providing an image forming apparatus comprising:

a transport device to transport recording sheets to receive a formed image;

a plurality of image forming units arranged in series along the recording sheet transport direction of said transport device, said image forming units respectively having one photosensitive member;

detection device to detect environmental conditions in said image forming apparatus; and a controller to change the transport spacing of the recording sheets transported by said transport device in accordance with environmental conditions detected by said detection device.

Humidity is an example of the aforesaid environmental conditions. The aforesaid detection device may detect humidity by measuring the moisture content of the recording sheet. The aforesaid controller may compare the humidity detected by said detection device with a preset threshold value, and increase the transport spacing of the recording sheets when the detected humidity exceeds said threshold value.

The aforesaid objects are further attained by providing an image forming apparatus comprising:

a transport device to transport recording sheets to receive a formed image;

a plurality of image forming units arranged in series along the recording sheet transport direction of said transport device, said image forming units respectively having one photosensitive member;

detection device to detect the condition of said recording sheet; and a controller to change the transport spacing of the recording sheets transported by said transport device in accordance with the condition of said recording sheet detected by said detection device.

Physical characteristics are an example of the aforesaid condition of the recording sheet. The detection device may detect the physical characteristics of the recording sheet by measuring the current flow to the transport device when said recording sheet is being transported by said transport device.

Another example of the condition of the recording sheet is the moisture content of the recording sheet. The detection device may detect the moisture content of the recording sheet by measuring the electrical resistance of the recording sheet.

The aforesaid objects are further attained by an image forming apparatus comprising:

an image forming unit having a photosensitive member;

a sheet supplying device to continuously supplying recording sheets to receive formed images to said image forming unit at a predetermined transport spacing;

detection device to detect the humidity in the environment of the image forming apparatus; and a controller to control said sheet supplying device so as to change the transport spacing of the recording sheets in accordance with the humidity detected by said detection device.

In the aforesaid image forming apparatus, it is desirable that the controller compares the humidity detected by said detection device with a preset threshold value, and increases the transport spacing of the recording sheets from a first distance to a second distance when the detected humidity exceeds said threshold value. It is further desirable that the second transport spacing is set longer than the circumferential length of the photosensitive member, and also desirable that the first transport spacing is set shorter than the circumferential length of the photosensitive member.

In the aforesaid image forming apparatus, the controller may change the recording sheet transport spacing without stopping the image forming operation performed by the image forming unit.

In the aforesaid image forming apparatus, the detection device may detect humidity by measuring the electrical resistance of the recording sheet.

In the aforesaid image forming apparatus, it is desirable that the sheet supplying device includes a transport belt for transporting the recording sheets at constant speed to the image forming unit and a pair of timing rollers capable of feeding and stopping a recording sheet by rotating/stopping of said timing rollers themselves which are provided upstream from said transport belt in the direction of sheet transport; in this instance it is desirable that the controller changes the recording sheet transport spacing by controlling the operation timing of said pair of timing rollers.

The aforesaid objects are further attained by providing a method to form images via an image forming apparatus provided with an image forming unit having a photosensitive member, said method comprising the steps of:

1) detecting the humidity of the environment of the image forming apparatus; and 2) changing the transport spacing of recording sheets to receive formed images and supplied to the image forming unit in accordance with the humidity detected in said first step.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

A preferred embodiment of the present invention is described hereinafter with reference to the accompanying drawings.

Figure 1:
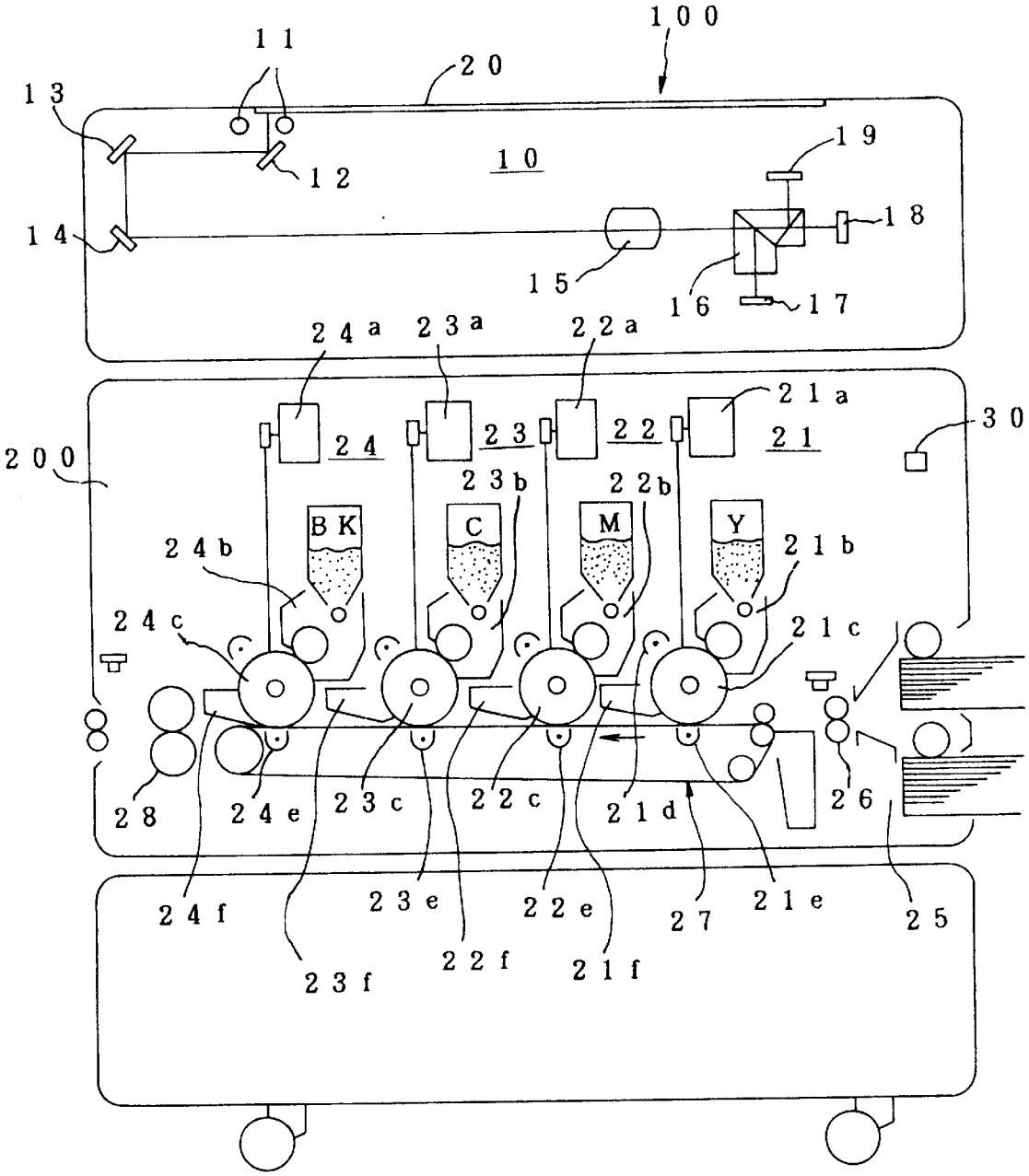
FIG. 1 is a section view showing the construction of a full color copier of an embodiment of the present invention.

FIG. 1 is a section view showing the construction of a full color copier of the tandem type in an embodiment of the present invention. In FIG. 1, image reading station 100 is provided with a document table 20, and a scanning optical system 10 comprising exposure lamp 11, mirror 12, mirrors 13 and 14, projection lens 15, and dichroic prism 16. Dichroic prism 16 resolves a color document placed on document table 20 into three colors of red (R), green (G), and blue (B), and projects the respective color images to charge-coupled devices (CCD) sensors 17, 18, and 19. CCD sensors 17, 18 and 19 output signals expressing each color image red (R), green (G) and blue (B) and their densities.

The signals expressing the images and densities output from the CCD sensors are converted to yellow (Y), magenta (M), cyan (C), and black (Bk) image data by image signal processing circuit 52 (refer to FIG. 2) comprising a well known electronic circuit and said converted image data are stored in an image memory. The image data stored in image memory are read out by image signal processing circuit 52 with a predetermined image forming timing, and output to four electrophotographic processing units 21, 22, 23, 24 of image processing station 200 described later.

Image processing station 200 is provided with four electrophotographic processing units or image forming units 21, 22, 23, 24 corresponding to each of the colors yellow (Y), magenta (M), cyan (C), and black (Bk), paper supply unit 25, pair of timing rollers 26 disposed at the outlet of paper supply unit 25, transfer belt 27 to transport the recording sheet fed through the pair of timing rollers 26, and fixing device 28 disposed downstream from transfer belt 27. Transfer belt 27 normally moves at constant speed in the arrow direction in the drawing to transport the recording sheet. A humidity sensor 30 is provided to detect the environmental humidity in image processing station 200.

Electrophotographic processing units 21, 22, 23, 24 are arranged in series along the direction of movement of transport belt 27, and having identical constructions. Unit 21 is described below by way of example. electrophotographic processing unit 21 comprises a laser oscillator 21*a*, developing device 21*b* loaded with yellow (Y) toner, photosensitive member 21*c*, charger 21*d*, transfer charger 21*e*, and cleaner 21*f*, and photosensitive member 21*c* is disposed adjacent to transfer belt 27. Electrophotographic units 22, 23, and 24 are identical in construction to unit 21 with the exception that each developing device is loaded with a different color toner.

The operation of the copier of the present embodiment having the aforesaid construction is described below. First, in electrophotographic processing unit 21, a laser beam emitted from laser oscillator 21*a* is modulated by yellow image data signals output from image signal processing circuit 52. The modulated laser beam is projected onto the surface of photosensitive member 21*c* which was previously charged to a predetermined potential by charger 21*d*. This process forms an electrostatic latent image of the image to be reproduced on the surface of photosensitive member 21*c*. The electrostatic latent image formed on the surface of photosensitive member 21*c* is developed by developing device 21*b* to form a yellow toner image.

On the other hand, a recording sheet is fed from paper supply unit 25. The pair of timing rollers 26 are initially stopped and stop the recording sheet fed from paper supply unit 25, and thereafter begin to rotate so as to fed the recording sheet such that the leading edge of the recording sheet is synchronized with the leading edge of the yellow image formed on the surface of photosensitive member 21*c*. The fed recording sheet is electrostatically adhered to transfer belt 27, so as to be transported to a transfer position at which photosensitive member 21*c* confronts transfer belt 27. At the transfer position, the yellow toner image formed on the photosensitive member 21*c* is transferred onto the recording sheet via the action of transfer charger 21*e*. The recording sheet bearing the transferred yellow toner image is then transported to the next electrophotographic processing unit 22 via transfer belt 27.

The processing executed in electrophotographic processing units 22, 23, and 24 is identical to that of unit 21.

In electrophotographic processing unit 22, the laser beam emitted from laser oscillator 22*a* is modulated by magenta image data output from image signal processing circuit 52 with a timing matching the arrival at the transfer position of unit 22 of the yellow toner image transferred to the recording sheet.

The modulated laser beam is projected onto the surface of photosensitive member 22*c*, and the electrostatic latent image thereby formed on the surface of photosensitive member 22*c* is developed by developing device 22*b* to form a magenta toner image. The magenta toner image is transferred to the recording sheet so as to be overlaid on the yellow toner image. The recording sheet bearing the overlaid magenta and yellow toner images is transported to the next electrophotographic processing unit 23 via transfer belt 27.

In electrophotographic processing unit 23, the laser beam emitted from laser oscillator 23*a* is modulated by cyan image data output from image signal processing circuit 52 with a timing matching the arrival at the transfer position of unit 23 of the overlaid yellow and magenta toner images transferred to the recording sheet.

The modulated laser beam is projected onto the surface of photosensitive member 23*c*, and the electrostatic latent image thereby formed on the surface of photosensitive member 23*c* is developed by developing device 23*b* to form a cyan toner image. The cyan toner image is transferred to the recording sheet so as to be overlaid on the yellow and magenta toner images. The recording sheet bearing the overlaid cyan, magenta and yellow toner images is transported to the next electrophotographic processing unit 24 via transfer belt 27.

In electrophotographic processing unit 24, the laser beam emitted from laser oscillator 24*a* is modulated by black image data output from image signal processing circuit 52 with a timing matching the arrival at the transfer position of unit 24 of the overlaid cyan, yellow and magenta toner images transferred to the recording sheet.

The modulated laser beam is projected onto the surface of photosensitive member 24*c*, and the electrostatic latent image thereby formed on the surface of photosensitive member 24*c* is developed by developing device 24*b* to form a black toner image. The black toner image is transferred to the recording sheet so as to be overlaid on the cyan, yellow and magenta toner images.

The recording sheet bearing the overlaid yellow, magenta, cyan, and black toner images is transported to fixing device 28 by transfer belt 27. The toner images on said recording sheet are fused into a full color image and fixed onto the recording sheet by the pressure and heat applied by fixing device 28. The recording sheet is ejected from the apparatus after the heat fixing process.

The controls for determining the environmental conditions which readily cause separation discharge and for increasing the transport spacing of the recording sheets are described below. Determination of the environmental conditions which readily cause separation discharge is accomplished by detecting the relative humidity in the atmosphere via a humidity sensor 30, and comparing the detected relative humidity to a preset threshold value (e.g., 70%). That is, if the detected relative humidity exceeds the threshold value, the environmental conditions are deemed to readily produce separation discharge and controls are executed to increase the recording sheet transport spacing. Specifically, the spacing at which recording sheets are fed is adjusted (increased) by changing the operating timing of the pair of timing rollers 26, and the image formation timing of each electrophotographic processing unit is adjusted to conform with said timing roller adjustment. Environmental conditions which readily produce separation discharge are determined experientially, and since the aforesaid threshold value of 70% is nothing more than an example, it is understood that the threshold value is not limited to this value.

A commonly known humidity sensor may be used as humidity sensor 30.

Particularly when the recording sheet is a paper medium such as plain paper, humidity may be detected based on the moisture content of the recording sheet by measuring the electrical resistance of the recording sheet or similar paper. Alternatively, the environmental conditions which readily produce separation discharge may be determined based on the physical characteristics of the recording sheet.

Figure 4:
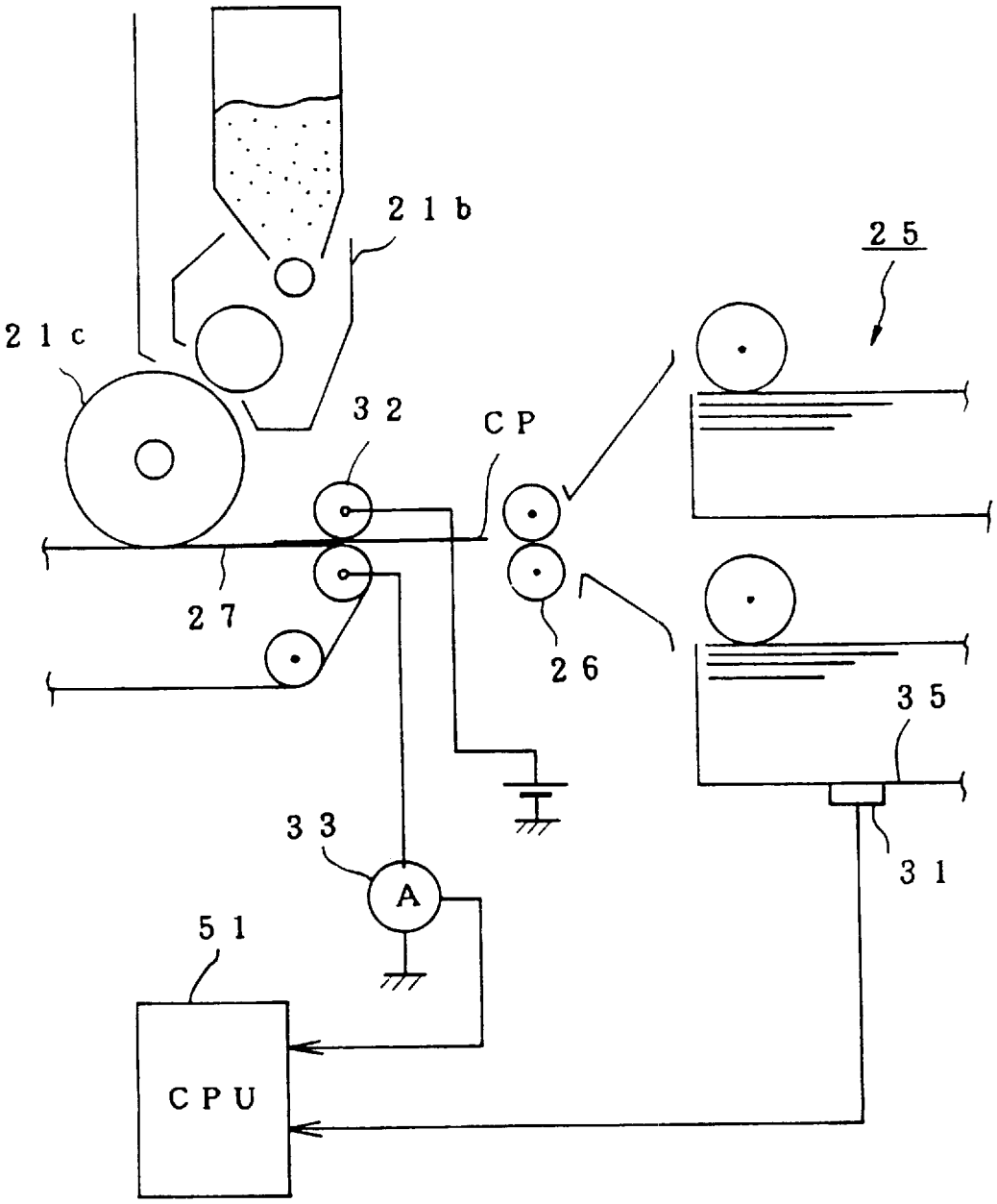
FIG. 4 shows the construction for measuring the physical characteristics and electrical resistance of the recording sheet.
Figure 5:
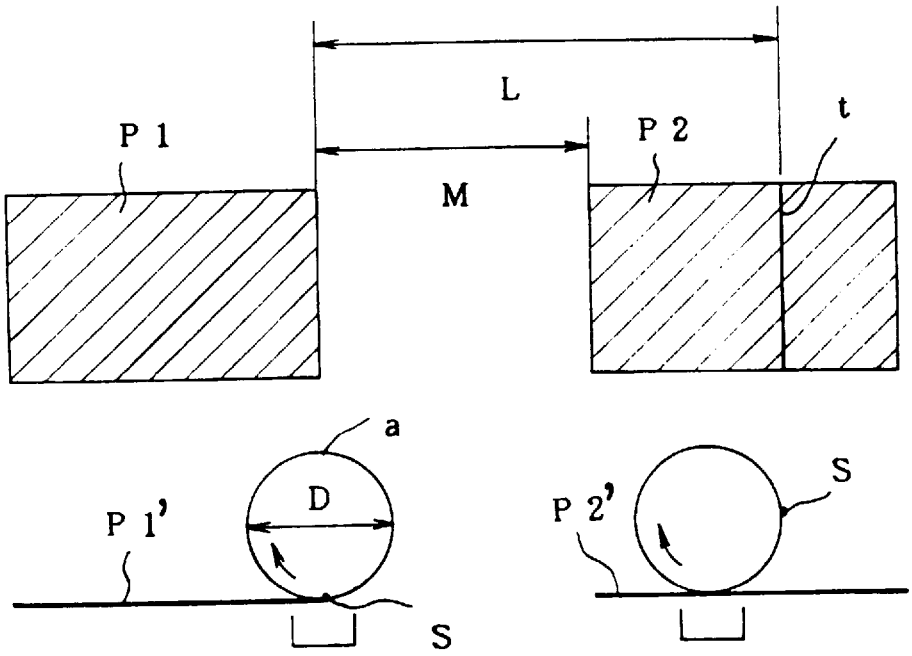
FIG. 5 shows a transfer image when a positive charge has accumulated on the surface of the photosensitive member due to separation discharge.

FIG. 4 shows an example of a measuring circuit for measuring the physical characteristics and electrical resistance of the recording sheet. Two electrodes in contact with the recording sheet and an electrical resistance sensor 31 which outputs the electrical resistance between said two electrodes as a detection value are provided underneath paper cassette 35 of paper supply unit 25, as a construction for measuring the electrical resistance of the recording sheet. Sensor 31 normally measures the electrical resistance of recording sheets within paper cassette 35 and output the measurement value.

On the other hand, an ammeter 33 is provided as a construction for measuring the physical characteristics of the recording sheet. A voltage is applied to transfer belt 27 and suction roller 32, and a recording sheet CP is electrostatically adhered to transfer belt 27 while said recording sheet is gripped between transfer belt 27 and suction roller 32. At this time, the physical characteristics of the recording sheet are detected by measuring the current flowing from the recording sheet CP to the transfer belt 27 using ammeter 33. In this method, since environmental conditions which readily produce separation discharge are determined based on the physical characteristics of the recording sheet, a higher degree of accuracy is possible than when using the aforesaid method utilizing the humidity sensor. The reason for this greater accuracy is that the responsiveness of the recording sheet during periods of moisture absorption cannot be determined when using a humidity sensor.

Environmental conditions which readily produce separation discharge also may be determined based on the two data of the measured physical characteristics of the recording sheet and the detection results of the humidity sensor.

Figure 2:
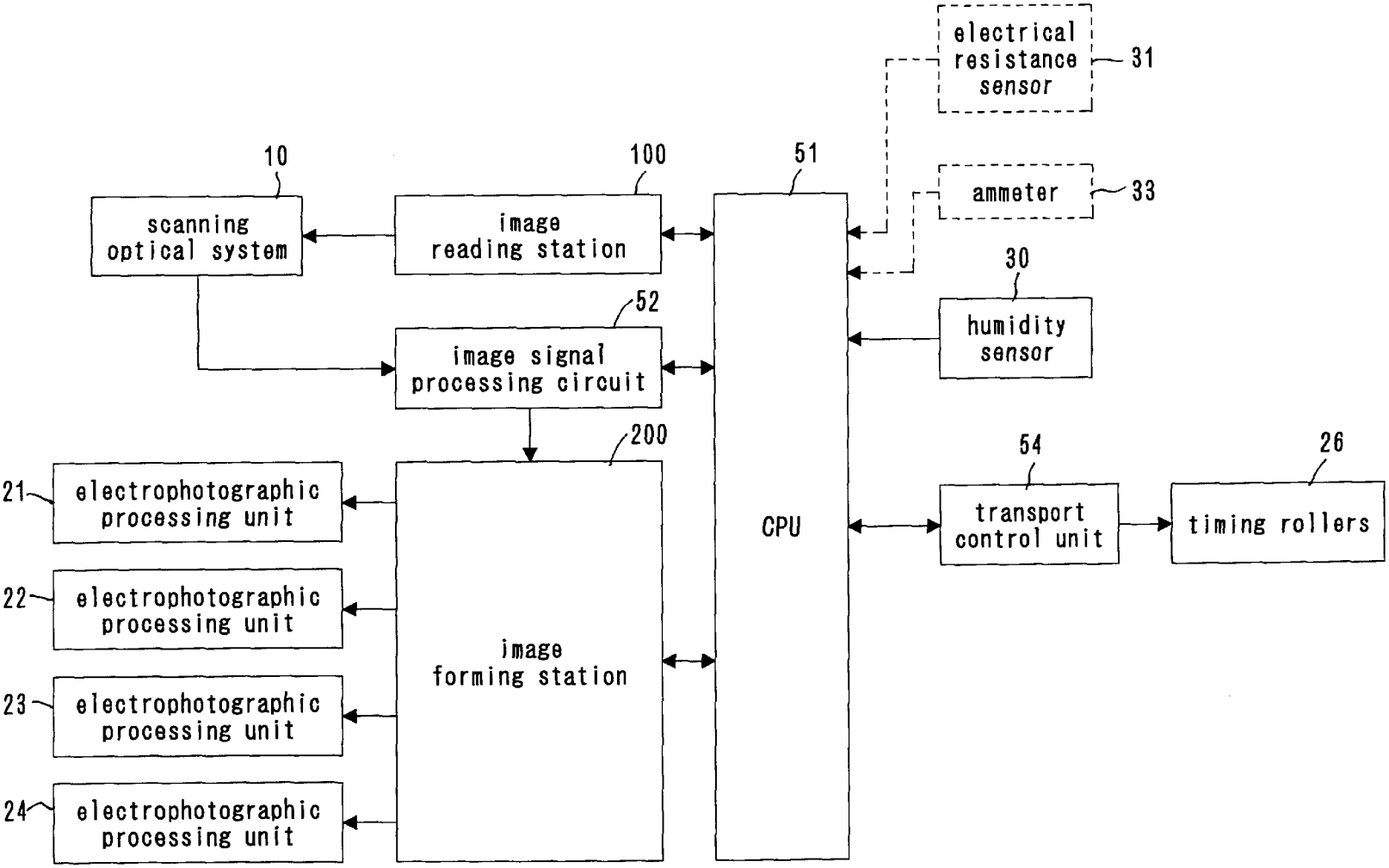
FIG. 2 is a block diagram of the control circuit of the copier of the present embodiments.

FIG. 2 shows an example of a control circuit provided in the copier of the present embodiment. The control circuit mainly comprises a central processing unit (CPU) 51. CPU 51 is connected to image reading station 100, image processing station 200, image signal processing circuit 52, humidity sensor 30, and transport control unit 54, and scanning unit 10 also is controlled by CPU 51 through image reading station 100. The pair of timing rollers 26 are controlled by CPU 51 through transport control unit 54.

This control circuit executes controls to detect the relative humidity and increase the transport spacing of the recording sheets. Specifically, when the humidity detected by humidity sensor 30 exceeds a predetermined threshold value of, for example, 70%, CPU 51 deems the environmental conditions are such that separation discharge may readily occur, and CPU 51 controls the operation timing of the pair of timing rollers 26 to increase the recording sheet transport spacing so as to be greater than the circumferential length of each of the photosensitive members 21*c*–24*c*. Furthermore, CPU 51 controls the output of the yellow, magenta, cyan, and black image data from the image memory of image signal processing circuit 52 to the electrophotographic processing units 21, 22, 23, 24 to a suitable time to match the aforesaid operation timing controls of the pair of timing rollers 26. Thereby, images are formed by the electrophotographic processing units in accordance with the increased transport spacing of the recording sheets.

Figure 3:
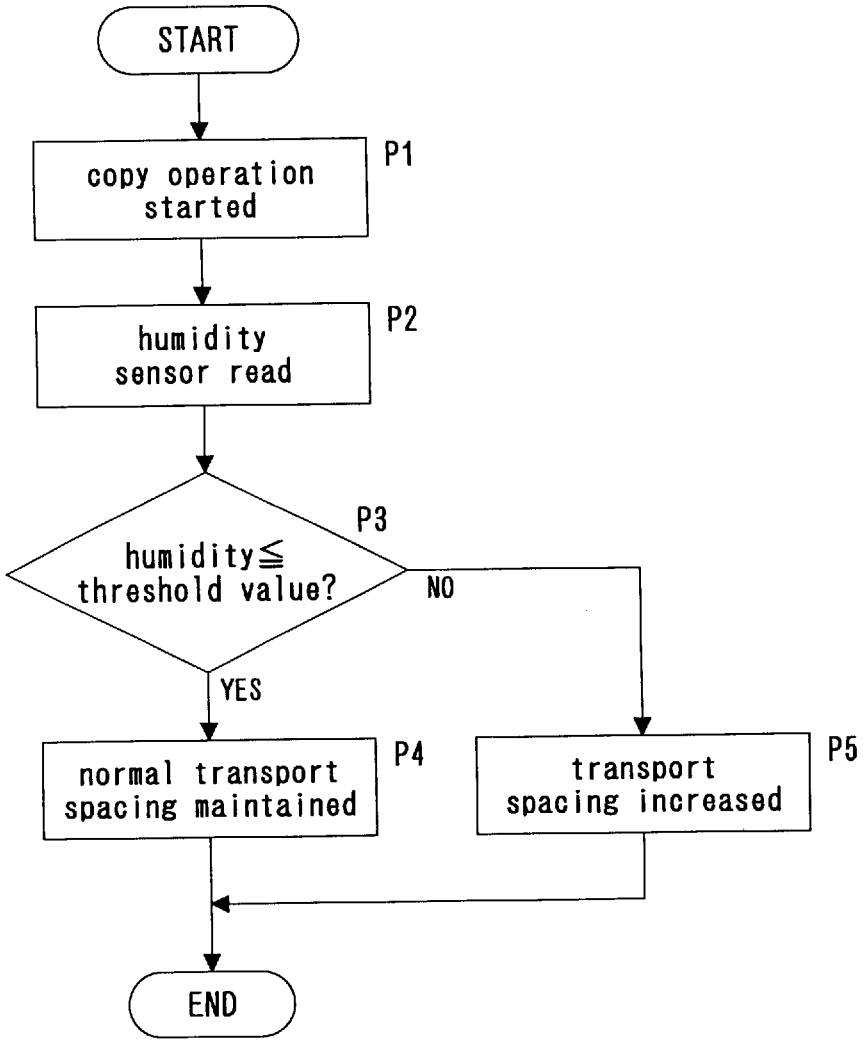
FIG. 3 is a flow chart illustrating the control operation executed by the copier of the present embodiment.

FIG. 3 is a flow chart illustrating the control operation executed by CPU 51. A copy operation starts (step P1), the output of the humidity sensor is read (step P2), and the sensor output is compared with a predetermined threshold value (e.g., 70% humidity) (step P3). If the detected humidity is less than the predetermined threshold value, it is deemed that separation discharge will not occur, and the operation timing of the pair of timing rollers 26 is controlled so as to maintain the normal transport spacing of the recording sheets (step P4). The normal transport spacing of the recording sheets is set so as to be less than the circumferential length of each of the photosensitive members 21*c*–24*c*. When the detected humidity exceeds the predetermined threshold value, there is deemed to be a high possibility that separation discharge will occur, and the operation timing of the pair of timing rollers 26 is controlled so as to increase transport spacing of the recording sheets so as to be greater than the circumferential length of each of the photosensitive members (step P5). The change in the transport spacing of the recording sheets is executed without stopping the image forming operation. Furthermore, the change in the transport spacing of the recording sheets also may be accomplished between one image forming operation and another image forming operation.

The copier of the present embodiment executes relatively high speed image forming operation by supplying recording sheets at a normal transport spacing when environmental conditions will not readily produce separation discharge (i.e., at normal humidity). On the other hand, separation discharge-induced image noise is not transferred to the recording sheet even when said noise is generated because the transport spacing of the recording sheets is increased when environmental conditions are such that there is a high possibility of separation discharge (i.e., at high humidity). Accordingly, image defects due to separation discharge are prevented while suppressing a reduction of production efficiency of the apparatus to a minimum limit. Furthermore, the present invention achieves a compact form factor and cost reduction because there is no need to increase the capacity of the delay memory or provide a charger to eliminate image noise caused by separation discharge.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising:

a transport device which transports recording sheets to receive a formed image;

a plurality of image forming units arranged in series along a recording sheet transport direction of said transport device, said image forming units respectively having one photosensitive member;

a detection device which detects environmental conditions in said image forming apparatus; and a controller which changes the transport spacing of a recording sheets transported by said transport device in accordance with environmental conditions detected by said detection device.

2. An image forming apparatus as claimed in claim 1, wherein said environmental conditions include humidity.

3. An image forming apparatus as claimed in claim 2, wherein said detection device detects the humidity by measuring the moisture content of a recording sheet.

4. An image forming apparatus as claimed in claim 2, wherein said controller compares the humidity detected by said detection device with a preset threshold value, and increases the transport spacing of the recording sheets when the detected humidity exceeds said threshold value.

5. An image forming apparatus comprising:

a transport device which transports recording sheets to receive a formed image;

a plurality of image forming units arranged in series along a recording sheet transport direction of said transport device, said image forming units respectively having one photosensitive member;

a detection device which detects the condition of a recording sheet; and a controller which changes the transport spacing of a recording sheets transported by said transport device in accordance with the condition of said recording sheet detected by said detection device.

6. An image forming apparatus as claimed in claim 5, wherein said condition of the recording sheet includes physical characteristics of the recording sheet.

7. An image forming apparatus as claimed in claim 6, wherein said detection device detects the physical characteristics of the recording sheet by measuring the current flow to the transport device when said recording sheet is being transported by said transport device.

8. An image forming apparatus as claimed in claim 5, wherein said condition of the recording sheet includes the moisture content of the recording sheet.

9. An image forming apparatus as claimed in claim 8, wherein said detection device detects the moisture content of the recording sheet by measuring the electrical resistance of the recording sheet.

10. An image forming apparatus comprising:

an image forming unit having a photosensitive member;

a sheet supplying device which continuously supplies recording sheets to receive a formed image to said image forming unit at a predetermined transport spacing;

a detection device which detects the humidity in the environment of the image forming apparatus; and a controller which controls said sheet supplying device so as to change the transport spacing of the recording sheets in accordance with the humidity detected by said detection device.

11. An image forming apparatus as claimed in claim 10, wherein said controller compares the humidity detected by said detection device with a preset threshold value, and increases the transport spacing of the recording sheets from a first distance to a second distance when the detected humidity exceeds said threshold value.

12. An image forming apparatus as claimed in claim 11, wherein said second transport spacing is set longer than the circumferential length of the photosensitive member.

13. An image forming apparatus as claimed in claim 12, wherein said first transport spacing is set shorter than the circumferential length of the photosensitive member.

14. An image forming apparatus as claimed in claim 10, wherein said controller changes the recording sheet transport spacing without stopping the image forming operation performed by the image forming unit.

15. An image forming apparatus as claimed in claim 10, wherein said detection device detects the humidity by measuring the electrical resistance of the recording sheet.

16. An image forming apparatus as claimed in claim 10, wherein said sheet supplying device includes a transport belt for transporting the recording sheets at constant speed to the image forming unit and a pair of timing rollers capable of feeding and stopping a recording sheet by rotating and stopping of said timing rollers themselves which are provided upstream from said transport belt in the direction of sheet transport, and said controller changes the recording sheet transport spacing by controlling the operation timing of said pair of timing rollers.

17. A method of forming images via an image forming apparatus provided with an image forming unit having a photosensitive member, said method comprising the steps of:

1) detecting the humidity of the environment of the image forming apparatus; and 2) changing the transport spacing of recording sheets to receive a formed image and supplied to the image forming unit in accordance with the humidity detected at the step 1.

18. A method as claimed in claim 17, wherein at the step 2, the humidity detected at the step 1 is compared with a preset threshold value, and the transport spacing of the recording sheets is increased from a first distance to a second distance when the detected humidity exceeds said threshold value.

19. A method as claimed in claim 18, wherein said second transport spacing is set longer than the circumferential length of the photosensitive member.

20. A method as claimed in claim 19, wherein said first transport spacing is set shorter than the circumferential length of the photosensitive member.

21. A method as claimed in claim 17, wherein at the step 2, the recording sheet transport spacing is changed without stopping the image forming operation performed by the image forming unit.

22. A method as claimed in claim 17, wherein at the step 1, the humidity is detected by measuring the electrical resistance of a recording sheet.

* * * * *

UNITED STATES PATENT AND TRADEMARK OFFICE

CERTIFICATE OF CORRECTION

PATENT NO. : 5,893,009

DATED : April 6, 1999

INVENTOR : Yamada

It is certified that error appears in the above-identified patent and that said Letter Patent is hereby corrected as shown below:

Claim 1, line 10, change "the" to --a--, and change "a" (second occurrence) to --the--.

Claim 5, line 10, change "the" to --a--, and change "a" (second occurrence) to --a--.

Signed and Sealed this

Seventeenth Day of October, 2000

*Attest:*

Q. TODD DICKINSON

*Attesting Officer*

*Director of Patents and Trademarks*